US009157645B1

(12) United States Patent
Goss et al.

(10) Patent No.: US 9,157,645 B1
(45) Date of Patent: Oct. 13, 2015

(54) APPARATUS, METHOD, AND SYSTEM FOR CONTROLLING FLOW OF A FLUID

(75) Inventors: Steven Goss, Corvallis, OR (US); Phillip Salvatori, Salem, OR (US)

(73) Assignee: Marvell International Ltd., Hamilton (BM)

( * ) Notice: Subject to any disclaimer, the term of this patent is extended or adjusted under 35 U.S.C. 154(b) by 613 days.

(21) Appl. No.: 12/873,908

(22) Filed: Sep. 1, 2010

Related U.S. Application Data

(60) Provisional application No. 61/241,315, filed on Sep. 10, 2009.

(51) Int. Cl.
*F24F 7/00* (2006.01)

(52) U.S. Cl.
CPC ..... *F24F 7/00* (2013.01)

(58) Field of Classification Search
CPC ... F24C 15/2021; F24C 15/20; F24F 11/0012
USPC ..... 236/49.3, 51; 62/259.1, 236, 186, 314; 454/61, 256, 258
See application file for complete search history.

(56) References Cited

U.S. PATENT DOCUMENTS 4,140,433 A * 2/1979 Eckel ..... 415/209.1
4,199,023 A * 4/1980 Phillips ..... 165/243
4,830,095 A * 5/1989 Friend ..... 165/208
5,271,558 A * 12/1993 Hampton ..... 236/49.3
5,364,304 A * 11/1994 Hampton ..... 454/258
RE37,245 E * 6/2001 Scholten et al. ..... 236/49.3
6,474,559 B2 * 11/2002 Park ..... 236/49.3
7,347,774 B2 * 3/2008 Aronstam et al. ..... 454/258
2001/0043050 A1 * 11/2001 Fisher, Jr. ..... 320/101
2004/0194484 A1 * 10/2004 Zou et al. ..... 62/186
2007/0119958 A1 * 5/2007 Kates ..... 236/1 B
2007/0119961 A1 * 5/2007 Kaiser ..... 236/49.3

FOREIGN PATENT DOCUMENTS

EP WO2008065332 A2 * 6/2008 ..... F24C 15/00
GB WO 2008/065332 * 6/2008 ..... F24C 15/20
WO WO 2008065332 A2 * 6/2008 ..... F24C 15/20

* cited by examiner

*Primary Examiner* — Emmanuel Duke

(57) ABSTRACT

Embodiments of the present disclosure provide an apparatus comprising a power supply, a wireless controller coupled to the power supply, the wireless controller being configured to wirelessly receive a command from a wireless thermostat of a ventilation system, the ventilation system having a vent through which a fluid passes, and a flow controller to automatically control an amount of flow of the fluid through the vent of the ventilation system based at least in part on the command received wirelessly from the wireless thermostat. Other embodiments may be described and/or claimed.

20 Claims, 6 Drawing Sheets

APPARATUS, METHOD, AND SYSTEM FOR CONTROLLING FLOW OF A FLUID

CROSS REFERENCE TO RELATED APPLICATIONS

The present application claims priority to U.S. Provisional Patent Application No. 61/241,315, filed Sep. 10, 2009, the entire specification of which is hereby incorporated by reference in its entirety for all purposes, except for those sections, if any, that are inconsistent with this specification.

TECHNICAL FIELD

Embodiments of the present disclosure relate to the field of ventilation systems (e.g., heating and/or cooling systems), and more particularly, to controlling a flow of a fluid, such as, for example air or water, through one or more vents of a ventilation system.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Ventilation systems—e.g., central heating and/or cooling systems—typically deliver heated or cooled fluid, such as air, through vents to various rooms or other localities of a building. Conventional central heating and/or cooling systems generally include adjustable vents that can be manually opened or closed to adjust an amount of airflow into a given room. Additionally, conventional central heating and/or cooling systems also typically include a temperature set point that can be manually adjusted to maintain a constant temperature in a particular room. However, such solutions usually require manual intervention.

SUMMARY

The present disclosure provides an apparatus comprising a power supply, a wireless controller coupled to the power supply, the wireless controller being configured to wirelessly receive a command from a wireless thermostat of a ventilation system, the ventilation system having a vent through which a fluid passes, and a flow controller to automatically control an amount of flow of the fluid through the vent of the ventilation system based at least in part on the command received wirelessly from the wireless thermostat.

BRIEF DESCRIPTION OF THE DRAWINGS

Embodiments of the present disclosure will be readily understood by the following detailed description in conjunction with the accompanying drawings. To facilitate this description, like reference numerals designate like structural elements. Embodiments herein are illustrated by way of example and not by way of limitation in the figures of the accompanying drawings.

DETAILED DESCRIPTION

Embodiments of the present disclosure describe apparatus, method, and system for controlling the flow of fluid through one or more vents of a ventilation system—e.g., a heating and/or cooling system. In the following detailed description, reference is made to the accompanying drawings which form a part hereof, wherein like numerals designate like parts throughout. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

For the purposes of the present disclosure, the phrase "A/B" means A or B. For the purposes of the present disclosure, the phrase "A and/or B" means "(A), (B), or (A and B)." For the purposes of the present disclosure, the phrase "at least one of A, B, and C" means "(A), (B), (C), (A and B), (A and C), (B and C), or (A, B and C)." For the purposes of the present disclosure, the phrase "(A)B" means "(B) or (AB)" that is, A is an optional element.

Various operations are described as multiple discrete operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

The description uses the phrases "in an embodiment," "in embodiments," or similar language, which may each refer to one or more of the same or different embodiments. Furthermore, the terms "comprising," "including," "having," and the like, as used with respect to embodiments of the present disclosure, are synonymous.

As used herein, the term module may refer to, be part of, or include an Application Specific Integrated Circuit (ASIC), an electronic circuit, a processor (shared, dedicated, or group) and/or memory (shared, dedicated, or group) that execute one or more software or firmware programs, a combinational logic circuit, and/or other suitable components that provide the described functionality.

Figure 1:
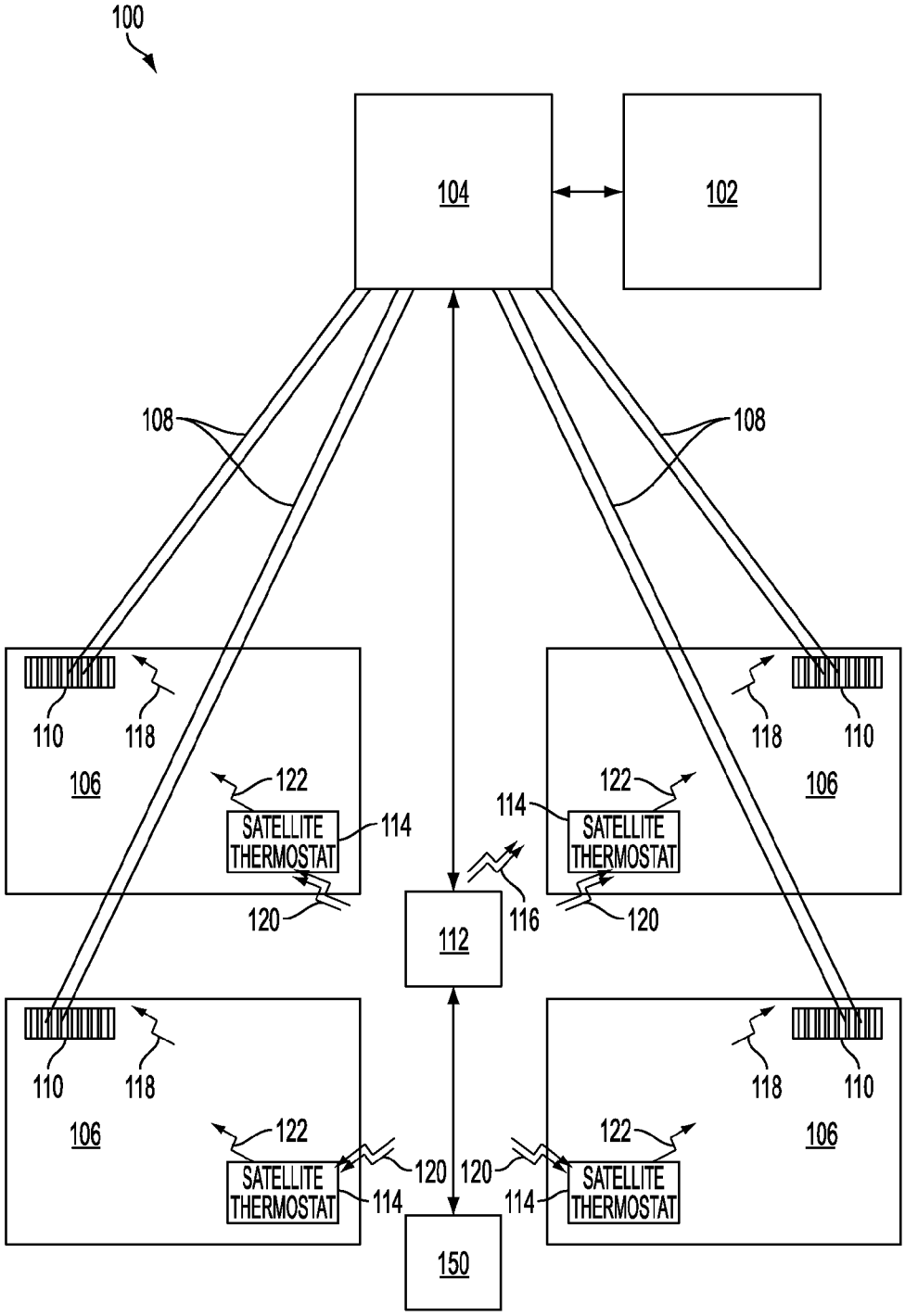
FIG. 1 schematically illustrates an example ventilation system.

FIG. 1 schematically illustrates an example ventilation system 100. The ventilation system 100 is intended to represent a variety of systems configured to deliver a fluid to one or more localities 106. The fluid can include, for example, a gas such as air or a liquid such as water. The fluid can be delivered for a variety of purposes including, for example, to heat and/or cool a building or other structure such as a pool. In other examples, the ventilation system 100 can be used as a filtration, humidification, or exhaust system, or provide any other suitable function associated with delivery of a fluid to one or more localities 106. The ventilation system 100 may include, for example, a central Heating, Ventilating, and Air Conditioning (HVAC) system for a home. For ease of discussion only, the ventilation system 100 of FIG. 1 and FIGS. 2-6 will be described as a heating and/or cooling system using air as a fluid. Similar techniques and configurations can be used for other fluids.

Generally, the ventilation system 100 includes heating and/or cooling means 102 operatively coupled to an air delivery assembly 104 to heat and/or cool air that is delivered to one or more localities 106 by the air delivery assembly 104. The heating and/or cooling means 102 can include, for example, a furnace to heat the air and/or an air conditioner to cool the air. The air delivery assembly 104 can include, for example, a blower to deliver the air to the one or more localities 106 using one or more ducts 108 coupled to one or more vents 110 that are disposed in the one or more localities 106. The localities 106 can be, for example, rooms of a building.

More or less localities 106, ducts 108, and vents 110 than depicted can be used in various embodiments. For example, a single duct 108 can be coupled to multiple vents 110, or multiple vents 110 can be disposed in a single locality 106. Moreover, the ducts 108 can be arranged such that larger ducts deliver the air from the air delivery assembly 104 and smaller ducts branch from the larger ducts to deliver the air to various localities 106.

A central thermostat 112 is coupled to the heating and/or cooling means 102 and/or the air delivery assembly 104 to control the delivery of air from the air delivery assembly 104. For example, the central thermostat 112 generally includes means (e.g., knob or digital interface) to set a desired temperature (e.g., a central set point temperature) and a thermometer such as a thermocouple to measure a temperature of air in a vicinity of the central thermostat 112. Based on a difference between the desired temperature and the measured temperature of the air in the vicinity of the central thermostat 112, the central thermostat 112 controls the delivery of warm or cool air to bring the temperature of the vicinity of the central thermostat 112 closer to the desired temperature. For example, the central thermostat 112 can engage a blower of the air delivery assembly 104 to deliver air that is heated or cooled by the heating and/or cooling means 102 until the desired temperature is reached within a pre-determined tolerance. The central thermostat 112 is generally placed in a central location of a building having multiple localities 106, but is not limited in this regard.

According to various embodiments, the central thermostat 112 is wireless-enabled to communicate wirelessly with other devices that communicate wirelessly. The central thermostat 112 may include a wireless network interface configured to communicate, for example, using an Institute of Electrical and Electronics Engineers (IEEE) standard such as IEEE 802.11 (e.g., Wi-Fi), IEEE 802.16, and/or IEEE 802.15 standards including Bluetooth standards. Other wireless network standards and/or protocols can also be supported.

The one or more vents 110 include a flow control assembly (e.g., flow control assembly 200 of FIG. 2) as described in connection with at least FIGS. 2-4. The flow control assembly is wireless-enabled to communicate over-the-air with the central thermostat 112. The central thermostat 112 can be programmed to wirelessly transmit control signals 116 such as commands to the flow control assembly coupled to the one or more vents 110 to reduce or increase the flow of fluid to the one or more vents 110. For example, the central thermostat 112 can be programmed to wirelessly transmit an airflow command to open or close the one or more vents 110 according to seasonal or other temperature-related changes such as sun exposure, time of day, and/or weather according to heating and/or cooling needs for the one or more localities 106. That is, the airflow commands (e.g., control signals 116) can include pre-set adjustments. Respective flow control assemblies of the one or more vents 110 may wirelessly receive control signals 118 transmitted directly from the central thermostat 112 or from one or more satellite thermostats 114 disposed in the one or more localities 106, or combinations thereof.

In an embodiment, one or more satellite thermostats 114 are disposed in a vicinity of the one or more vents 110. For example, the one or more satellite thermostats 114 are disposed in the one or more localities 106 to provide finer temperature control for the one or more localities 106. The one or more satellite thermostats 114 can include, for example, means (e.g., knob or digital interface) for setting a desired local temperature (e.g., local set point temperature) for the one or more localities 106. Accordingly, the one or more satellite thermostats 114 may be positioned within the one or more localities 106 based on convenience for an occupant to adjust the desired local temperature. Further, the one or more satellite thermostats 114 can include means (e.g., thermometer) to measure a local temperature for the one or more localities 106.

The one or more satellite thermostats 114 are wireless enabled for over-the-air communication with other wireless devices such as the central thermostat 112 or with a flow control assembly coupled to the one or more vents 110. The one or more satellite thermostats 114 can include, for example, one or more wireless (e.g., Wi-Fi) relays. The one or more satellite thermostats 114 can be powered, for example, by battery or an alternating current (AC) power outlet in the one or more localities 106.

According to various embodiments, the central thermostat 112 is configured to wirelessly transmit or broadcast control signals 116 such as airflow commands. For example, the control signals 116 can include a central set point temperature of the central thermostat 112. The control signals 116 can be received, for example, by the one or more satellite thermostats 114 and/or by a flow control assembly (e.g., 200) coupled to the one or more vents 110.

In an embodiment, the central thermostat 112 transmits control signals 120 including a central set point temperature to the one or more satellite thermostats 114. Based on the transmitted central set point temperature, a current local temperature of the one or more localities 106, and/or the local set point temperature, the one or more satellite thermostats 114 can transmit control signals 122 to the flow control assembly coupled to the one or more vents 110 to increase or reduce the heating and/or cooling for the one or more localities 106 accordingly. The satellite thermostats 144 can determine whether additional cooling or heating is needed for the one or more localities 106, for example, by comparing the transmitted central set point temperature with a current local temperature of the one or more localities 106 and/or a local set point temperature of the satellite thermostat and/or any pre-determined temperature offsets from the central set point temperature for the one or more localities 106, or any suitable combination thereof. In this regard, the one or more satellite thermostats 114 allow an occupant of the one or more localities 106 to locally adjust a temperature for temporary conditions.

An electronic system 150 is coupled to the central thermostat 112 to store instructions that, when executed by a processor, result in actions associated with techniques and methods described herein. For example, the electronic system 150 can be part of the central thermostat 112. In other embodiments, the electronic system 150 is separate from the central thermostat 112 and communicatively coupled with the central thermostat 112 by wired or wireless technologies. According to various embodiments, the electronic system 150 is a personal computer running an application that automatically and dynamically (e.g., periodically) adjusts airflow to the one or more localities 106 according to techniques described herein.

The electronic system 150 can be further communicatively coupled to the one or more satellite thermostats 114 and/or flow control assembly 200 using wired or wireless technologies. According to various embodiments, the electronic system 150 is configured to connect with a wireless local area network (WLAN) such that the electronic system 150 controls the transmission of control signals 116, 118, 120, 122 via the WLAN or other suitable wireless network. The electronic system 150 is further described in connection with FIG. 7.

Figure 2:
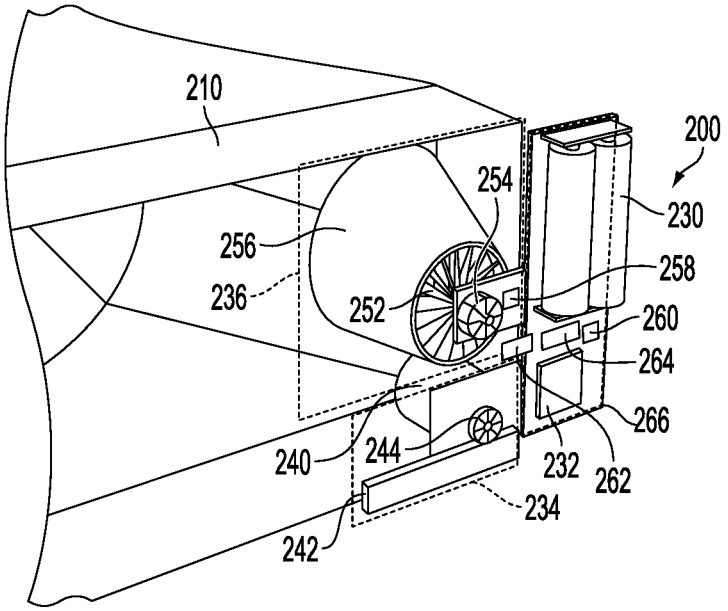
FIG. 2 schematically illustrates a flow control assembly coupled to a vent of a ventilation system.

FIG. 2 schematically illustrates a flow control assembly 200 coupled to a vent 210 of a ventilation system (e.g., ventilation system 100 of FIG. 1), in accordance with various embodiments. The flow control assembly 200 includes a power supply 230 to power a wireless controller 232 and to power flow control means 234 (e.g., a flow controller) controlled by the wireless controller 232. The flow control assembly 200 further includes recharging means 236 (e.g., a recharging assembly) to recharge the power supply 230 using airflow through the vent 210.

According to various embodiments, the power supply 230 includes one or more batteries. The one or more batteries can include any suitable type of battery including, for example, disposable batteries such as zinc-carbon and alkaline batteries or rechargeable batteries such as nickel-cadmium, nickel-zinc, nickel metal hydride and lithium-ion batteries. The batteries can include, for example, button cells, 9-volt, AAA cell, AA cell, C cell, or D cell batteries. The power supply 230 is not limited to these battery types and can include any suitable type of battery. A battery-type power supply allows the flow control assembly 200 to be retrofit onto existing vents (e.g., vent 210) of a heating and/or cooling system without requiring wiring or other connection to a building's (e.g., household) power supply.

The wireless controller 232 is configured to wirelessly transmit and/or receive information including airflow commands from a wireless thermostat (e.g., central thermostat 112 or satellite thermostats 114 of FIG. 1). The wireless controller 232 can include, for example, an interface such as a radio antenna configured to communicate, for example, using an IEEE standard such as IEEE 802.11 (e.g., Wi-Fi), IEEE 802.16, and/or IEEE 802.15 standards including Bluetooth standards. Other wireless network standards and/or protocols can also be supported. The wireless controller 232 can include, for example, a Wi-Fi controller configured to communicate with other devices wirelessly using a WLAN connection. The wireless controller 232 controls flow control means 234 according to wireless commands received by the wireless controller 232.

The flow control means 234 automatically controls flow of air through the vent 210 based at least in part on airflow commands from a wireless thermostat (e.g., central thermostat 112 or satellite thermostats 114). The flow control means 234 can include any suitable mechanism to reduce and/or increase airflow through the vent 210. In an embodiment, the flow control means 234 includes a rack 242 and pinion 244 assembly coupled to a motor 240. The motor 240 is powered by the power supply 230 and activated/controlled by the wireless controller 232. When activated, the motor 240 turns the pinion 244 to drive the rack 242. The rack 242 is coupled to a flow diverter (e.g., 300 of FIG. 3) to reduce and/or increase airflow through the vent 210. The flow diverter can include any of a variety of flow diverting mechanisms including, for example, a door, grating, mesh, or other suitable mechanism that obstructs or diverts the flow of the fluid through the vent 210.

Figure 3:
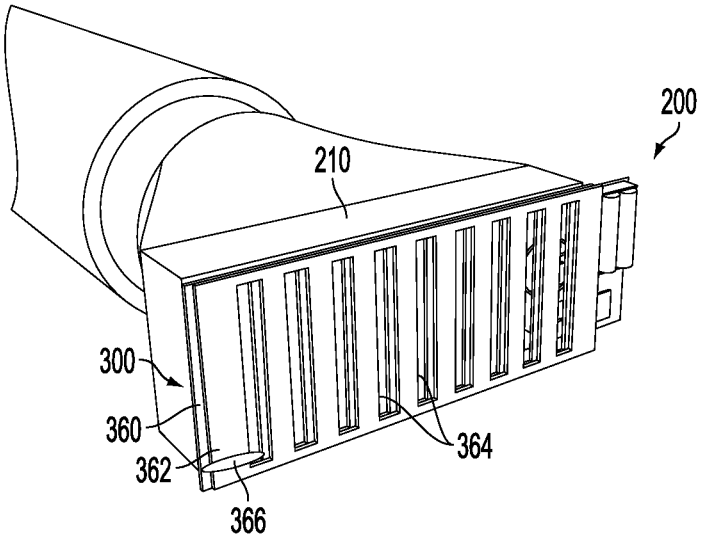
FIG. 3 schematically illustrates an example flow diverter controlled by the flow control assembly of FIG. 2.

FIG. 3 illustrates an example flow diverter 300 controlled by the flow control assembly 200 of FIG. 2. In the illustrated embodiment, the flow diverter 300 is a grating structure having a first grating 360 and a second grating 362 adjacent to and/or overlapping the first grating 360, as illustrated. The grating structure substantially covers an opening of the vent 210 and includes slots 364 to allow air to flow through.

According to various embodiments, the rack (e.g., rack 242 of FIG. 2) is coupled to or is part of the first grating 360 and/or the second grating 362 such that the motor 240 of FIG. 2, when activated, moves the first grating 360 relative to the second grating 362 to divert airflow through the vent 210. For example, the first grating 360 and/or the second grating 362 can be moved relative to one another to provide an "open" position and/or a "closed" position. When the flow diverter 300 is in an "open" position, air flows through slots 364 of the grating structure in a relatively uninhibited manner. When the flow diverter 300 is in a "closed" position, the first grating 360 and the second grating 362 overlap such that air flow through the vent 210 is substantially inhibited. A variety of positions between the "open" and "closed" position can be used to divert air according to various embodiments.

In an embodiment, the flow diverter 300 includes a spring mechanism 366 or other mechanism that stores potential energy to automatically move the flow diverter 300 to an "open" position if the power supply (e.g., power supply 230 of FIG. 2) lacks sufficient power to move or activate the flow diverter 300. For example, a spring of the spring mechanism 366 can be compressed by the first grating 360 or the second grating 362 to store potential energy when the motor (e.g., motor 240 of FIG. 2) is activated to move the flow diverter 300 to a "closed" position. When the power supply lacks sufficient power to move the flow diverter 300 to an "open" position and/or to maintain the "closed" position against the contrary force of the compressed spring, the spring mechanism 366 automatically moves the flow diverter 300 to the "open" position using the potential energy stored in being compressed. Automatically opening the flow diverter 300 when the power supply is low allows air to flow through the vent 210 and recharge the power supply as will be further described herein.

Returning again to FIG. 2, the flow control assembly 200 further includes recharging means 236 to recharge the power supply 230 (e.g., one or more batteries) using airflow of the vent 210. In the illustrated embodiment, the recharging means 236 includes a fan 252 disposed in a path of airflow through the vent 210. A generator 254 is coupled to the fan 252 to generate an electrical current for recharging circuitry 258 to recharge the power supply 230. In an embodiment, a fan shroud 256 is coupled to the fan 252 to increase airflow across the fan blades.

The flow control assembly 200 further includes a temperature sensor 260 and a flow sensor 262. The temperature sensor 260 (e.g., thermometer) can be disposed in a variety of suitable positions to measure a local temperature in a vicinity of the vent 210. According to various embodiments, the flow control means 234 automatically controls the flow of air through the vent 210 based at least in part on a difference between the measured local temperature and a set point temperature (e.g., central set point temperature). The flow sensor 262 can include any of a variety of sensor types (e.g., Venturi) that are placed in a path of the fluid flowing through the vent 210 to measure, e.g., a velocity or other flow rate of the fluid.

In an embodiment, the fan 252 is used to gather air flow rate information for the flow control assembly 200.

The flow control assembly 200 can further include circuitry 264 to support and/or facilitate power management, motor drive, and/or communication between the wireless controller 232 and various modules of the flow control assembly 200. According to various embodiments, circuitry 264 associated with the power supply 230, the wireless controller 232, the flow control means 234, or the recharging means 236 (e.g., recharging circuitry 258), or any combination thereof, is disposed on a single printed circuit board 266. In an embodiment, circuitry 264 associated with the temperature sensor 260, the flow sensor 262, and/or the wireless controller 232 is disposed on the single printed circuit board 266.

According to various embodiments, the power supply 230 and the wireless controller 232 are disposed external to and adjacent to the vent 210, as illustrated. The motor 240 and the fan 252 are disposed internal to the vent 210, as illustrated.

Figure 4:
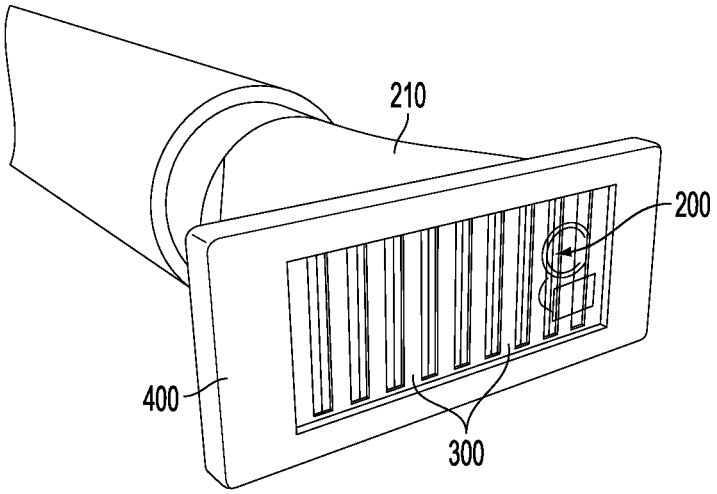
FIG. 4 schematically illustrates an example cover for the vent and flow control assembly of FIG. 3.

FIG. 4 schematically illustrates a cover 400 for the vent 210 and flow control assembly 200 of FIG. 3, in accordance with various embodiments. The cover 400 is configured to substantially cover the flow control assembly 200 and the flow diverter 300, as illustrated. In an embodiment, the cover 400 substantially covers the power supply (e.g., 230 of FIG. 2), the wireless controller (e.g. 232 of FIG. 2), the motor (e.g., 240 of FIG. 2), the first grating (e.g., 360 of FIG. 3), and the second grating (e.g., 362 of FIG. 3), as illustrated. The cover 400 can be made of any suitable material including, for example, metal, ceramic, and/or polymer. According to various embodiments, the flow control assembly (e.g., 200 of FIG. 2) including the flow diverter (e.g., 300 of FIG. 3) and the cover 400 can be retrofit onto existing vents of a building's heating and/or cooling system.

Figure 5:
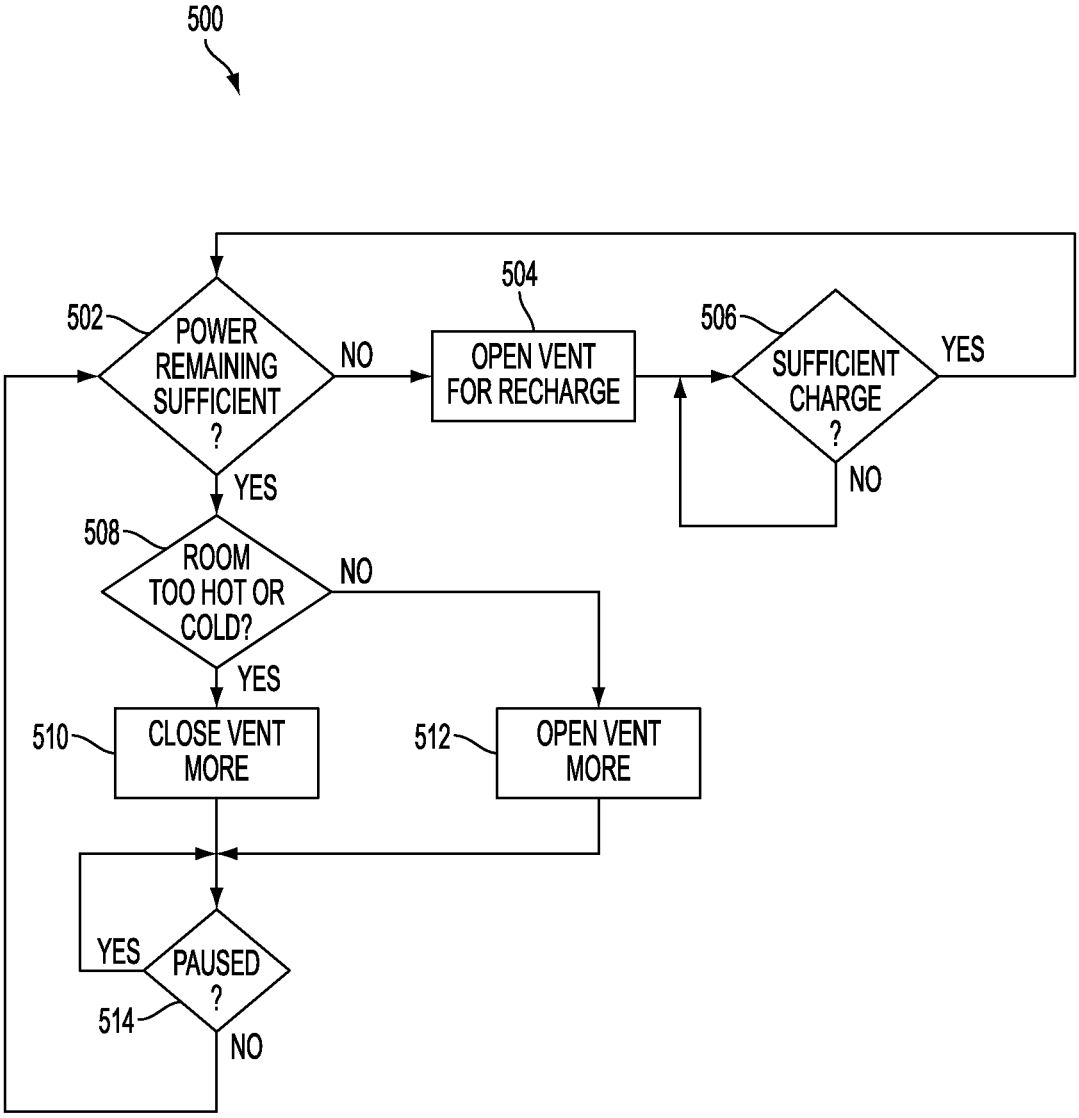
FIG. 5 schematically illustrates a process flow diagram for control techniques associated with the flow control assembly.

FIG. 5 schematically illustrates a process flow diagram 500 for control techniques associated with a flow control assembly (e.g., flow control assembly 200 of FIG. 2). The process flow diagram 500 describes automatic control logic for a heating and/or cooling system (e.g., ventilation 100).

Although actions described in connection with the process flow diagram 500 are described as being performed by a wireless controller (e.g., wireless controller 232 of FIG. 2), the actions can be performed by any of a variety of modules of the heating and/or cooling system. For example, a power management module can be configured to perform actions associated with blocks 502, 504, 506, and 514. A flow control module can be configured to perform actions associated with blocks 508, 510, and 512. Such modules can be disposed, e.g., in a printed circuit board (e.g., printed circuit board 266 of FIG. 2) of the flow control assembly, an electronic system (e.g., electronic system 150 of FIGS. 1 and 7), a central thermostat (e.g., central thermostat 112 of FIG. 1), and/or one or more satellite thermostats (e.g., satellite thermostat 114 of FIG. 1).

At 502, the wireless controller determines whether power remaining in a power supply (e.g., power supply 230 of FIG. 2) is sufficient. For example, the wireless controller can periodically check a power level of the power supply to determine whether the power level is below a pre-determined threshold. The pre-determined threshold can be set, e.g., to provide sufficient power to activate flow control means (e.g., flow control means 234 of FIG. 2) in order to facilitate recharging of the power supply. That is, if the power remaining is insufficient (e.g., below the pre-determined threshold), the wireless controller fully opens the vent, at 504, for recharge when air starts to flow. For example, the flow control means can be activated to move the flow diverter (e.g., flow diverter 300 of FIG. 3) to an "open" position to allow air to flow through the vent (e.g., 210 of FIG. 3). The flow of air can recharge one or more batteries of the power supply using recharging means (e.g., recharging means 236 of FIG. 2) such as a fan (e.g., fan 252 of FIG. 2) coupled to a generator (e.g., generator 254 of FIG. 2).

At 506, the wireless controller determines whether the power supply has sufficient charge. For example, the wireless controller can periodically check to determine whether a power level of the power supply is above a pre-determined threshold as a result of the recharging. The pre-determined threshold at 506 can be, for example, greater or equal to the pre-determined threshold described at 502. If the power level of the power supply is not above the pre-determined threshold at 506, then the wireless controller continues to periodically check whether the charge is sufficient. Once the charge is determined to be sufficient, the process flows back to 502 to determine whether sufficient power remains in the power supply.

If the power remaining in the power supply is sufficient at 502, then the wireless controller determines whether the room is too hot or cold at 508. The room can be, for example, a locality of the one or more localities (e.g., localities 106 of FIG. 1). The wireless controller can determine whether the room is too hot or cold in a variety of ways described herein. For example, a local measured temperature of the room can be compared to a set point temperature associated with either a satellite thermostat or a central thermostat, or combinations thereof. If a difference between the local measured temperature and the set point temperature is greater than a pre-determined threshold, then the room is too hot or cold.

If the wireless controller determines that the room is too hot or cold, then the wireless controller closes the vent more at 510 to inhibit the heated or cooled air from entering the room. On the other hand, if the wireless controller determines that the room is not too hot or cold (e.g., not hot or cold enough), the wireless controller opens the vent more at 512 to allow more of the heated or cooled air to enter the room.

At 514, a pause can be used facilitate control of timing of various actions of the process flow diagram 500. The pause can be time-based, wait-for-command pause, or other type of pause. For example, the pause can be used to tune a periodicity or other timing of actions such as closing the vent more at 510 or opening the vent more at 512 for power management and/or to avoid too frequent adjustments of the airflow.

According to various embodiments, the use of the pause and/or the length of the pause is based at least in part on available power of a power supply used to automatically adjust the airflow of the vent. Such use of the pause may facilitate fewer adjustments to airflow, for example, when the power supply is low (e.g., below a pre-determined threshold).

According to various embodiments, the use of the pause and/or the length of the pause is based at least in part on a temperature difference. The temperature difference can be, for example, between a local measured temperature in a vicinity of the vent and a set point temperature (e.g., local or central set point temperature) or between a locally adjusted set point temperature for the vicinity of the vent and a central set point temperature for heating and/or cooling system. Such use of the pause may facilitate fewer adjustments to airflow, for example, when the temperature difference is small (e.g., below a pre-determined threshold).

Figure 6:
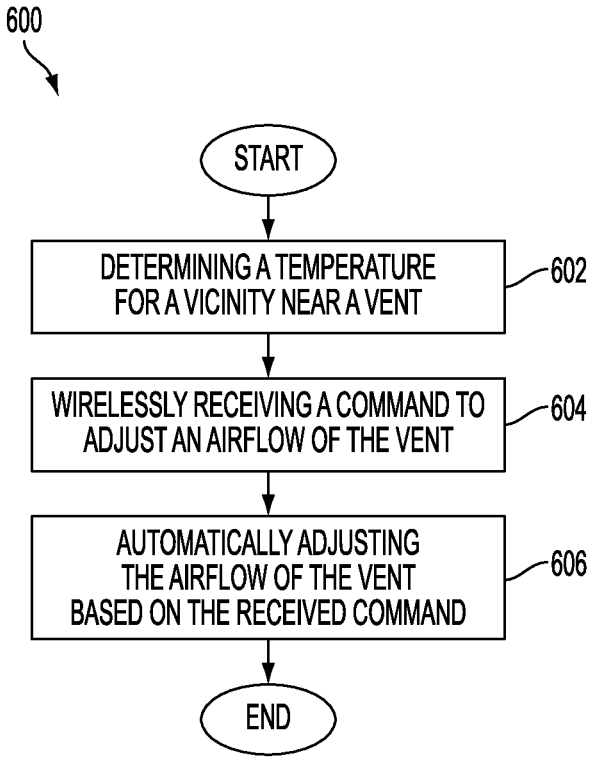
FIG. 6 schematically illustrates a method to control airflow through a vent.

FIG. 6 schematically illustrates a method 600 to control airflow through a vent, in accordance with various embodiments. At 602, the method 600 includes determining a temperature for a vicinity near a vent. The vicinity near the vent can include, for example, one or more localities such as rooms that are serviced by the vent.

The temperature can be determined according to a variety of techniques. For example, the temperature can be determined using a thermometer disposed in the vicinity near the vent. In an embodiment, the thermometer (e.g., temperature sensor 260 of FIG. 2) is part of the flow control assembly (e.g., 200 of FIG. 2). In another embodiment, the thermometer is part of the satellite thermostat (e.g., 114 of FIG. 1) disposed in the vicinity near the vent. Once determined, the temperature for the vicinity near the vent can be wirelessly transmitted by the wireless controller (e.g., 232 of FIG. 2) of the flow control assembly or the satellite thermostat to other wireless-enabled devices (e.g., the central thermostat 112 or the electronic system 150 of FIG. 1).

At 604, the method 600 includes wirelessly receiving a command to adjust an airflow of the vent. The command to adjust the airflow of the vent can be received, for example, by the wireless controller of the flow control assembly. In one embodiment, the command to adjust the airflow is based on a pre-set seasonal adjustment. For example, a central thermostat (e.g., 112 of FIG. 1) can be programmed to send a wireless command to one or more flow control assemblies disposed in one or more localities to open or close the respective vents (e.g., 110) during a particular season.

The command to adjust the airflow can be based on a real-time feedback system that automatically and dynamically controls airflow through a vent based on local temperature conditions. In an embodiment, the command to adjust the airflow of the vent is based at least in part on the determined temperature for the vicinity near the vent. For example, if a difference between the temperature for the vicinity and a set point temperature (e.g., central set point temperature or local set point temperature) is greater than a pre-determined threshold, a wireless-enabled device (e.g., central thermostat 112, satellite thermostats 114, or electronic system 150) wirelessly transmits the command to the flow control assembly via the wireless controller to adjust the airflow of the vent. The command can be based on other temperature differences or techniques described herein.

In an embodiment, the command to adjust the airflow of the vent is based on available power of a power supply used to automatically adjust the airflow of the vent. For example, a frequency of airflow commands or an update rate to adjust the airflow may increase if the available power of the power supply is greater than a pre-determined threshold value and decrease if the available power of the power supply is less than the pre-determined threshold.

In another embodiment, the update rate is based at least in part on a temperature difference as described herein. For example, the update rate may increase if the temperature difference (e.g., between a measured temperature of the vicinity near the vent and a set point temperature) is greater than a pre-determined threshold value and decrease if the temperature difference is less than the pre-determined threshold. In an embodiment, the update rate is defined in a periodic manner. Multiple pre-determined thresholds can be used to provide greater precision or resolution in tuning and/or optimizing power management of the power supply using these techniques.

At 606, the method 600 includes automatically adjusting the airflow of the vent based on the received command. In an embodiment, the flow control assembly automatically adjusts the airflow of the vent by engaging a flow control mechanism to increase or reduce the airflow of the vent by, for example, activating a motor (e.g., 240 of FIG. 2) controlled by the wireless controller (e.g., 232 of FIG. 2) to move a flow diverter (e.g., 300 of FIG. 3). The flow diverter can include a first grating (e.g., 360 of FIG. 3) that is moved relative to a second grating (e.g., 362 of FIG. 3) to open or close the vent.

In an embodiment, the airflow of the vent is automatically adjusted using a spring mechanism (e.g., 366 of FIG. 3) or other mechanism that stores potential energy. For example, the flow control assembly can be used to close the vent according to a received airflow command. The spring mechanism can be coupled to the flow control mechanism such that closing the vent compresses the spring mechanism. If the power supply has insufficient power to activate the motor or is below a pre-determined threshold to operate the flow control mechanism, the spring mechanism automatically opens the vent to allow any subsequent airflow to recharge the power supply using recharging means (e.g. 236 of FIG. 2).

Figure 7:
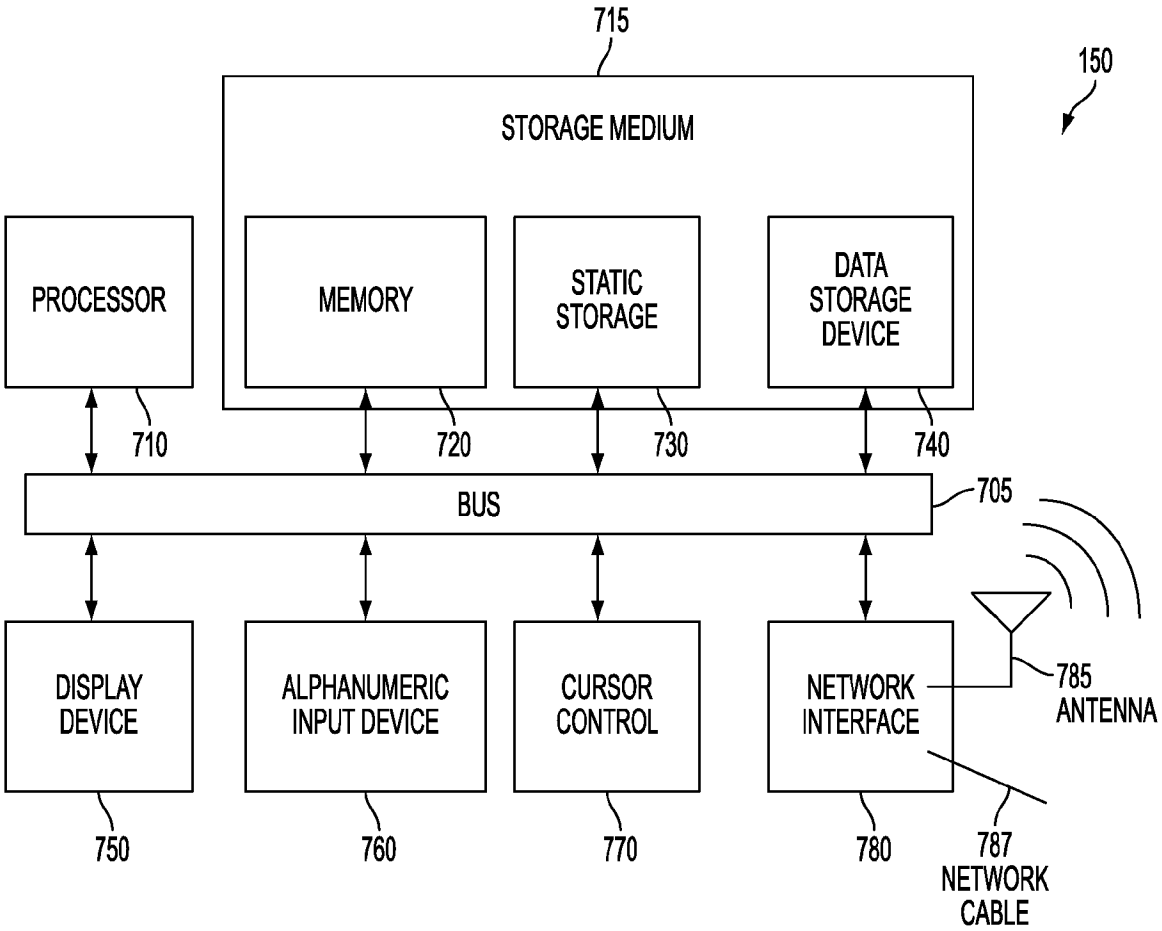
FIG. 7 schematically illustrates an electronic system that can be used to store and/or execute instructions associated with techniques described herein.

FIG. 7 schematically illustrates the electronic system 150 of FIG. 1 that can be used to store and/or execute instructions associated with techniques described herein. For example, the electronic system 150 can be used to store and/or execute instructions that result in actions described in connection with methods and techniques herein. The electronic system 150 is intended to represent a range of electronic devices (either wired or wireless) including, for example, desktop computer devices, laptop computer devices, personal computers (PC), servers, wireless-enabled thermostats, personal digital assistants (PDA) including cellular-enabled PDAs, pocket PCs, tablet PCs, but is not limited to these examples and can include other electronic devices. Alternative electronic systems can include more, fewer and/or different components.

The electronic system 150 includes a bus 705 or other communication device or interface to communicate information, and processor 710 coupled to bus 705 to process information. Bus 705 can be a single system bus or a number of buses of the same or different types bridged together. The processor 710 is representative of one or more processors and/or co-processors The electronic system 150 also includes a storage medium 715, which represents a variety of types of storage including memory 720, static storage 730, and data storage device 740. The storage medium 715 is coupled to bus 705 to store information and/or instructions that are processed and/or executed by processor 710. The storage medium 715 can include more or less types of storage than depicted. In one embodiment, the storage medium 715 is an article of manufacture having instructions stored thereon, that if executed, result in actions described herein. For example, the electronic system 150 can send or transmit airflow commands or otherwise manage the transmission of airflow commands as described herein.

The electronic system 150 includes random access memory (RAM) or other storage device 720 (may be referred to as "memory"), coupled to bus 705. The memory 720 is used to store temporary variables or other intermediate information during execution of instructions by processor 710. Memory 720 includes, for example, a flash memory device.

The electronic system 150 can also include read only memory (ROM) and/or other static storage device 730 coupled to bus 705 to store static information and instructions for processor 710. Data storage device 740 may be coupled to bus 705 to store information and instructions. Data storage device 740 can include, for example, a magnetic disk or optical disc and corresponding drive coupled with the electronic system 150.

The electronic system 150 is coupled via bus 705 to display device 750, such as a cathode ray tube (CRT) or liquid crystal display (LCD), to display information to a user. Alphanumeric input device 760, including alphanumeric and other keys, can be coupled to bus 705 to communicate information and command selections to the processor 710. Cursor control 770 is another type of input device and includes, for example, a mouse, a trackball, or cursor direction keys to communicate information and command selections to the processor 710 and to control cursor movement on the display 750.

The electronic system 150 further includes one or more network interfaces 780 to provide access to network 720, such as a local area network, but is not limited in this regard. The network interface 780 can include, for example, a wireless network interface having antenna 785, which may represent one or more antennae. The wireless network interface communicates, for example, using an Institute of Electrical and Electronics Engineers (IEEE) standard such as IEEE 802.11 (e.g., Wi-Fi), IEEE 802.16, and/or IEEE 802.15 standards including Bluetooth standards. Other wireless network standards and/or protocols can also be supported. The network interface 780 can also include, for example, a wired network interface to communicate with remote devices via network cable 787, which can be, for example, an Ethernet cable, a coaxial cable, a fiber optic cable, a serial cable, or a parallel cable.

Although certain embodiments have been illustrated and described herein, a wide variety of alternate and/or equivalent embodiments or implementations calculated to achieve the same purposes may be substituted for the embodiments illustrated and described without departing from the scope of the present disclosure. This application is intended to cover any adaptations or variations of the embodiments discussed herein. Therefore, it is manifestly intended that embodiments described herein be limited only by the claims and the equivalents thereof.

What is claimed is:

1. An apparatus comprising:

a power supply, wherein the power supply comprises a rechargeable battery;

a wireless controller coupled to the power supply, the wireless controller being configured to wirelessly receive a command from a wireless thermostat of a ventilation system, the ventilation system having a vent through which a fluid passes;

a flow controller to automatically control an amount of flow of the fluid through the vent of the ventilation system based at least in part on the command received wirelessly from the wireless thermostat, wherein the flow controller comprises a motor that is coupled to the rechargeable battery, wherein the motor is configured to, irrespective of the command wirelessly received from the wireless thermostat, automatically open the vent to permit the flow of the fluid through the vent if a power level of the rechargeable battery is determined to be below a first pre-determined threshold;

a recharging assembly to recharge the rechargeable battery based on the flow of fluid through the vent; and a spring mechanism coupled to the vent, wherein the spring mechanism is configured to automatically open the vent if the power level of the rechargeable battery is determined to be below a second pre-determined threshold such that the automatic opening of the vent by the spring mechanism results in flow of the fluid through the vent, thereby resulting in charging of the rechargeable battery by the recharging assembly.

2. The apparatus of claim 1, further comprising:

a temperature sensor coupled to the wireless controller, the temperature sensor to measure a local temperature at a first distance from the vent.

3. The apparatus of claim 2, wherein the flow controller is configured to automatically control the amount of flow of fluid through the vent based at least in part on a difference between (i) the local temperature and (ii) a set point temperature of the ventilation system.

4. The apparatus of claim 2, further comprising:

a flow sensor coupled to the wireless controller, the flow sensor to measure a flow of the fluid through the vent, wherein circuitry for the flow sensor, the temperature sensor, and the wireless controller is disposed on a single printed circuit board.

5. The apparatus of claim 1, wherein the flow controller comprises a flow control mechanism having:

the motor;

a first grating coupled to the motor; and a second grating adjacent to the first grating, wherein the motor is configured to move the first grating relative to the second grating to control the amount of flow of the fluid through the vent.

6. The apparatus of claim 5, wherein:

the spring mechanism is coupled to the first grating; and the spring mechanism is configured to move the first grating relative to the second grating to provide an open position of the vent.

7. The apparatus of claim 1, wherein the recharging assembly comprises:

recharging circuitry coupled to the power supply;

a generator coupled to the recharging circuitry; and a fan to turn the generator using the flow of fluid through the vent.

8. The apparatus of claim 7, further comprising:

a fan shroud coupled to the fan to increase a flow of fluid across the fan.

9. The apparatus of claim 1, wherein the spring mechanism is configured to automatically open the vent in response to the power level of the rechargeable battery not being sufficient to operate the motor to open the vent.

10. The apparatus of claim 1, wherein the spring mechanism is configured to store potential energy when the vent is at least partially closed, and wherein the potential energy stored in the spring automatically opens the vent if the power level of the rechargeable battery is below the second predetermined threshold.

11. The apparatus of claim 1, wherein the spring mechanism is configured to store potential energy when the vent is at least partially closed, and wherein the potential energy stored in the spring automatically opens the vent in response to the power level of the rechargeable battery not being sufficient to operate the motor to maintain the vent at an at least partially closed position.

12. A method comprising:

wirelessly receiving, by a wireless controller disposed adjacent to a vent of a ventilation system, a command;

automatically adjusting, by the wireless controller, an amount of flow of fluid through the vent based at least in part on the received command;

periodically checking a power level of a rechargeable battery coupled to a motor to determine whether the power level is below a first pre-determined threshold;

irrespective of the received command, activating the motor to open the vent if the power level of the rechargeable battery is determined to be below the first pre-determined threshold;

based on the flow of fluid through the vent, recharging, by a recharging assembly, the rechargeable battery; and automatically opening the vent, by spring mechanism, if the power level of the rechargeable battery is determined to be below a second pre-determined threshold such that the automatic opening of the vent by the spring mechanism results in the flow of the fluid through the vent, thereby resulting in charging of the rechargeable battery by the recharging assembly.

13. The method of claim 12, further comprising:

determining a local temperature at a first distance from the vent;

wherein the command is a command to adjust the amount of flow of fluid through the vent and is based at least in part on the determined local temperature for the vicinity near the vent.

14. The method of claim 13, wherein the command is based at least in part on a difference between the (i) local temperature for the vicinity and (ii) a set point temperature of the ventilation system.

15. The method of claim 12, wherein automatically adjusting the amount of flow of fluid through the vent comprises:

engaging a flow control mechanism to increase or reduce the flow of fluid through the vent.

16. The method of claim 15, wherein engaging the flow control mechanism comprises:

activating the motor to move a first grating positioned over the vent relative to a second grating adjacent to the first grating.

17. The method of claim 16, wherein:

the spring mechanism is coupled to the first grating; and the second pre-determined threshold is insufficient to activate the motor.

18. The method of claim 12, wherein:

the command is wirelessly received in a periodic manner defining an update rate;

the update rate is dependent at least in part on available power of the rechargeable battery.

19. The method of claim 12, wherein the command is wirelessly received in a periodic manner defining an update rate;

wherein the update rate is dependent at least in part on a difference between (i) a local temperature at a first distance from the vent and (ii) a set point temperature of the ventilation system.

20. The method of claim 12, wherein:

automatically adjusting the amount of flow of fluid through the vent comprises automatically adjusting the amount of flow of fluid through the vent in a periodic manner, such that there is at least a pause for a predetermined time period between two consecutive adjustments of the amount of flow of fluid through the vent; and the method further comprises in response to the power level of the rechargeable battery being below a threshold power level, setting the predetermined time period of the pause to a first value.

* * * * *